US007040510B1

(12) United States Patent
Hester

(10) Patent No.: US 7,040,510 B1
(45) Date of Patent: May 9, 2006

(54) EXTENSION ARM FOR TRIGGER PUMP SPRAY CONTAINERS

(76) Inventor: Kevin R. Hester, 1803 Cottage Landing La., Houston, TX (US) 77077

( * ) Notice: Subject to any disclaimer, the term of this patent is extended or adjusted under 35 U.S.C. 154(b) by 0 days.

(21) Appl. No.: 11/042,248

(22) Filed: Jan. 24, 2005

(51) Int. Cl.
*B67D 5/64* (2006.01)

(52) U.S. Cl. ..... 222/174; 222/183.1; 222/509

(58) Field of Classification Search ..... 222/174, 222/383.1, 509; 141/279
See application file for complete search history.

(56) References Cited

U.S. PATENT DOCUMENTS

| | | | |
|---|---|---|---|
| 2,720,422 | A | 10/1955 | Mercur |
| 3,716,195 | A | 2/1973 | Silva |
| 4,023,711 | A | 5/1977 | Sena |
| 4,432,472 | A | 2/1984 | Lamm |
| 5,368,202 | A | 11/1994 | Smrt |
| 5,485,960 | A | 1/1996 | Troudt |
| 5,518,148 | A | 5/1996 | Smrt |
| 6,659,670 | B1 | 12/2003 | Blouse |
| 6,663,307 | B1 | 12/2003 | Kopanic et al. |

*Primary Examiner*—Philippe Derakshani
(74) *Attorney, Agent, or Firm*—Kenneth A. Roddy

(57) ABSTRACT

An extension arm device for releasably holding, manipulating, and remote operation of conventional trigger pump spray containers having a manual trigger pump spray head thereon. The extension arm is an elongate tubular member having a mounting receptacle at a distal end for releasably receiving and securing the trigger pump spray container and pump spray head thereto, a handle and trigger assembly at the proximal end, and an actuator rod connected to the trigger assembly at the proximal end extending through the arm and having an opposed outer end configured to engage and operate the trigger of the trigger pump spray head. Manual reciprocation of the trigger assembly at the proximal end is transmitted to the pump spray head trigger by the actuator rod to pump liquid from the container and discharge it through the nozzle of the spray head.

15 Claims, 7 Drawing Sheets

EXTENSION ARM FOR TRIGGER PUMP SPRAY CONTAINERS

BACKGROUND OF THE INVENTION

Field of the Invention

This invention relates generally to extension arms for spraying apparatus and, more particularly, to an extension arm for holding and manipulating conventional manual trigger pump spray containers, and remote operation of the trigger of the trigger pump spray head.

BRIEF DESCRIPTION OF THE PRIOR ART

Conventional "aerosol spray" cans and canisters contain materials under pressure and are typically actuated by a user pressing a valve plunger nozzle installed on the valve stem that activates the can's valve and releases the pressurized material. Conventional manual "trigger pump spray" containers contain materials that are not under pressure and are typically provided with a removable trigger pump dispensing unit that is threadedly engaged on the top of the container and includes a manually operated trigger that pumps the contents through a spray nozzle by repeatedly squeezing and releasing the trigger.

Both, conventional "aerosol spray" cans and canisters and manual "trigger pump spray" containers require that the user hold the canister or container in his or her hand, and the surface to be sprayed must be no further away than can be reached by the spray pattern of the nozzle member.

A common problem with both types of sprayers, except for some specialty spray nozzles designed to project a narrow stream a long distance, is that the spray patterns tend to fan out rather quickly, and the user must hold the canister or container within several inches of the target area. Consequently, a user must stand on a chair, ladder, or other elevating means in order to apply the spray to high elevations, such as the upper portions of windows, mirrors, wasp nests, tree limbs, etc., or must bend over or kneel to apply the spray to ground insects and ground-level areas, such as on weeds, ant beds, or under a bush or other plant, and the like.

Another problem with both conventional "aerosol spray" cans and canisters and manual "trigger pump spray" containers, is that many users would prefer to keep their distance from certain types of spray chemicals, such as pesticides, regardless of the capability of the sprayer.

There are several patents that disclose various extension arms that are designed to hold conventional "aerosol spray" cans and canisters and have an actuating mechanism that engages and presses the valve plunger nozzle member installed on the valve stem to releases the pressurized material.

Mercur, U.S. Pat. No. 2,270,422 discloses a device for mounting aerosol spray containers having an elongate tubular member with a base configured to receive the bottom rim of an aerosol container, a spring clamp to grip the container, and a bell crank lever pivotally mounted at the distal end that is operated by an actuating rod to depresses the valve plunger.

Silva, U.S. Pat. No. 3,716,195 discloses an extension device for spraying a line on the pavement which has an elongate extension arm with a support bar and a pair of spring clips at the distal end to receive and grip an aerosol spray can. A flexible generally L-shaped actuator mounted on the support bar and engaged by one end of an actuating rod is flexed downwardly to depresses the valve plunger when the user presses a thumb button at the opposite end of the actuating rod.

Smrt, U.S. Pat. Nos. 5,368,202 and 5,518,148 disclose a device for mounting aerosol spray containers having an elongate tubular member with a hollow cylinder at the distal end that receives an aerosol container in a horizontal position, and a bell crank lever pivotally mounted at the distal end that is operated by an actuating rod connected with a trigger at the proximal end to move the valve plunger to a discharging position.

Kopanic et al, U.S. Pat. No. 6,663,307 discloses a device for spraying pesticides and/or agricultural treatment chemicals that has a housing configured to retain an aerosol spray canister, an actuator rod on the housing configured to contact an overcap attached to the canister, a shaft connected to the housing, and a linkage to reverse a triggering force so that the actuator pushes against the overcap. Attachments can be provided in front of the sprayer nozzle, such as a shroud to limit back spray, a rake to disturb soil prior to treatment, a tapered director to focus spray in corners, or a fan shaped outlet to provide a wide spray.

There are several patents that are directed toward various devices that are designed to hold a conventional pressurized paint "spray gun" handle and have an actuating mechanism that engages and actuates the trigger of the pressurized spray gun nozzle. Pressurized paint spray gun handles have an elongate pistol grip with a trigger and hoses and/or cables which convey paint, atomizing air, propellant gas and electrical current to the gun; generally terminating either at the base of the grip, just above the grip or in front of the trigger location.

Sena, U.S. Pat. No. 4,023,711 discloses an extension arm for a pressurized paint spray gun handle wherein the gun is locked into a receptacle at the free end of a tubular arm pivoted at one end of an elongated tubular stock. The spray gun trigger is engaged by an operating finger, spring-biased toward the "off" position, which is operated by means of a sheathed, flexible cable through an operating lever mounted at the end of the stock farthest from spray gun receptacle. The relative angular position of the receptacle-bearing arm and the stock is adjustable. The trigger operates an air valve governing the admission of the compressed air to the gun, and, thereby, the amount of paint dispensed and the degree of atomization.

Troudt, U.S. Pat. No. 5,485,960 discloses a paint spray gun extender apparatus for mounting a pressurized paint spray gun trigger handle. The apparatus includes an elongate hollow extension pole with a cable running through the pole between a handle on one end and a spray gun mounting apparatus on its other end. The mounting apparatus comprises a vertical support plate adjustably secured to a flat portion at one end of the pole to pivot relative thereto. A pivoting arm is secured to the distal end of the support plate, and the cable is connected to the arm and extends from the arm down the pole to an actuating control lever. An adjustable trigger actuator extends outwardly from the arm for placement next to the spray gun trigger. The spray gun handle is secured in a C-shaped grip on the support plate with the trigger actuator next to the spray gun trigger, and the spray gun trigger is actuated by pulling the cable to simulate a hand grasping the spray gun handle.

There are also several patents that are directed toward various devices that are designed to hold a conventional "trigger pump spray" container and have an actuating mechanism that engages and actuates the trigger of the trigger pump spray head.

Lamm, U.S. Pat. No. 4,432,472 discloses a liquid sprayer unit which is configured to removably mount a manual pump spray container onto a floor buffing machine, which includes a container for the liquid, a frame for supporting the container, a pump spray head which is attached to the container, a mounting assembly for attaching the container frame to the housing of the buffing machine, and a chain which runs from the spray head to the handle of the buffer for actuation of the spray head by the user. The chain includes a first loop at one end one that passes around the container and through a hole in a sleeve mounted on the pump spray trigger, an intermediate loop, and a third loop at the other end for hooking the chain onto the buffer handle. Actuation of the pump sprayer is accomplished by pulling the intermediate loop toward the buffer handle.

Blouse, U.S. Pat. No. 6,659,670 discloses a mop having a manual pump spray bottle mounted in the mop head. A trigger is hinged to the mop handle and a cable is connected between the trigger and the pump spray mechanism on the spray bottle, and a spring is connected between the trigger and the inner end of the mop handle. The nozzle on the spray bottle is positioned towards one side of the mop head, and angled to spray the fluid at an acute angle across the front of the mop head.

The above-described devices that are designed to hold and operate conventional pressurized "aerosol spray" cans and canisters have actuating mechanisms that are incapable of operating the trigger of a trigger pump spray head of a conventional "trigger pump spray" container. The above-described prior art devices that hold a pressurized paint "spray gun" handle have mounting members that are particularly designed to engage the handgrip portion of the spray gun handle and would not be suitable for accommodating conventional "pump spray" containers of various shapes and sizes. The above-described devices that are designed to hold a manual "trigger pump spray" container of a particular size and shape would not accommodate a variety of various shapes and sizes of conventional pump spray containers, nor allow the user to manipulate and position the container with respect to a variety of ground level and elevated target areas.

The present invention is distinguished over the prior art in general, and these patents in particular by an extension arm device for holding, manipulating, and remote operation of a conventional trigger pump spray container of the type having a manual trigger pump spray head thereon. The extension arm is an elongate tubular member having a mounting receptacle at a distal end for releasably receiving and securing the trigger pump spray container and pump spray head thereto, a handle and trigger assembly at the proximal end, and an actuator rod connected to the trigger assembly at the proximal end extending through the arm and having an opposed outer end configured to engage and operate the trigger of the trigger pump spray head. Manual reciprocation of the trigger assembly at the proximal end is transmitted to the pump spray head trigger by the actuator rod and causes the pump head trigger to pump liquid from the container and discharge it through the nozzle of the spray head.

SUMMARY OF THE INVENTION

It is therefore an object of the present invention to provide an extension arm device for holding, manipulating, and remote operation of a conventional trigger pump spray container having a manual trigger pump spray head installed thereon.

It is another object of this invention to provide an extension arm device for holding, manipulating, and remote operation of a variety of various shapes and sizes of conventional trigger pump spray containers having manual trigger pump spray heads installed thereon.

Another object of this invention is to provide an extension arm device for holding, manipulating, and remote operation of a conventional trigger pump spray container having a manual trigger pump spray head installed thereon that allows a user located a distance from an elevated or ground-level target area to position the container within several inches of the target area and apply a liquid thereto.

Another object of this invention is to provide an extension arm device for holding, manipulating, and remote operation of a conventional trigger pump spray container having a manual trigger pump spray head installed thereon that allows a user to maintain a safe distance from a target area while applying undesirable or hazardous chemicals to the target area.

A further object of this invention is to provide an extension arm device for holding, manipulating, and remote operation of a conventional trigger pump spray container having a manual trigger pump spray head installed thereon that allows a user to operate the trigger of the manual trigger pump spray head when applying undesirable or hazardous chemicals to a target area without contacting the spray head or container with their hands.

A further object of this invention is to provide an extension arm device for holding, manipulating, and remote operation of a conventional trigger pump spray container having a manual trigger pump spray head installed thereon that reduces the risk of being bitten or stung while applying insecticides, pesticides, and other chemicals to a target area.

A still further object of this invention is to provide an extension arm device for holding, manipulating, and remote operation of a conventional trigger pump spray container having a manual trigger pump spray head installed thereon that is simple in construction, inexpensive to manufacture, and rugged and reliable in operation.

Other objects of the invention will become apparent from time to time throughout the specification and claims as hereinafter related.

The above noted objects and other objects of the invention are accomplished by an extension arm device for holding, manipulating, and remote operation of a conventional trigger pump spray container of the type having a manual trigger pump spray head thereon. The extension arm is an elongate tubular member having a mounting receptacle at a distal end for releasably receiving and securing the trigger pump spray container and pump spray head thereto, a handle and trigger assembly at the proximal end, and an actuator rod connected to the trigger assembly at the proximal end extending through the arm and having an opposed outer end configured to engage and operate the trigger of the trigger pump spray head. Manual reciprocation of the trigger assembly at the proximal end is transmitted to the pump spray head trigger by the actuator rod and causes the pump head trigger to pump liquid from the container and discharge it through the nozzle of the spray head.

DESCRIPTION OF THE SECOND PREFERRED EMBODIMENTS

Figure 1:
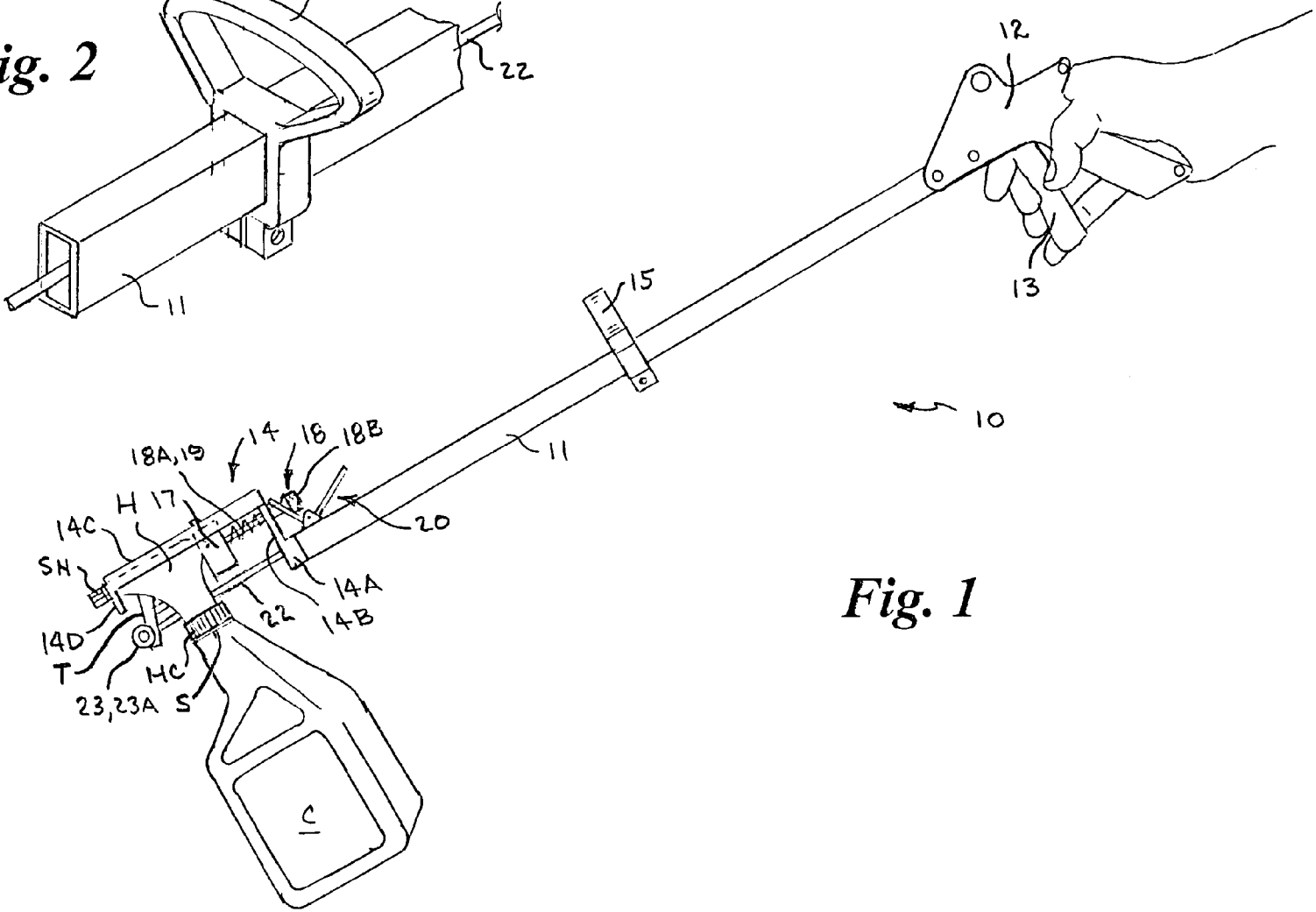
FIG. 1 is a perspective view of a first embodiment of the extension arm device in accordance with the present invention, having a conventional manual trigger pump spray container mounted at one end thereof.
Figure 2:
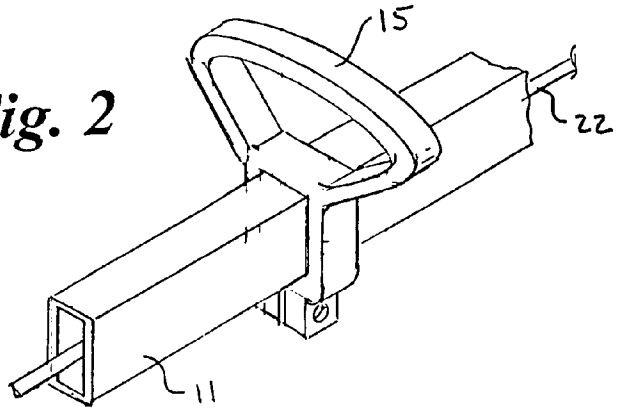
FIG. 2 is a partial isometric view of a handle mounted on the extension arm.

Referring to the drawings by numerals of reference, FIG. 1 shows a first preferred embodiment of the extension arm device 10 having mounted at one end thereof a conventional manual trigger pump spray container C equipped with a manual trigger pump spray head H.

Referring additionally to FIGS. 2 through 5, the extension arm device 10 has an elongate tubular arm member 11, preferably of rectangular cross section, with a pistol grip 12 and trigger 13 assembly secured at one end (referred to as the proximal end, for ease of description) and a mounting receptacle 14 at the opposed end (referred to as the distal end) for releasably mounting the manual trigger pump spray container therein. A second hand grip 15 may be secured to the tubular arm 11 intermediate the pistol grip 12 and the mounting receptacle to facilitate manipulating and carrying the device.

Figure 3:
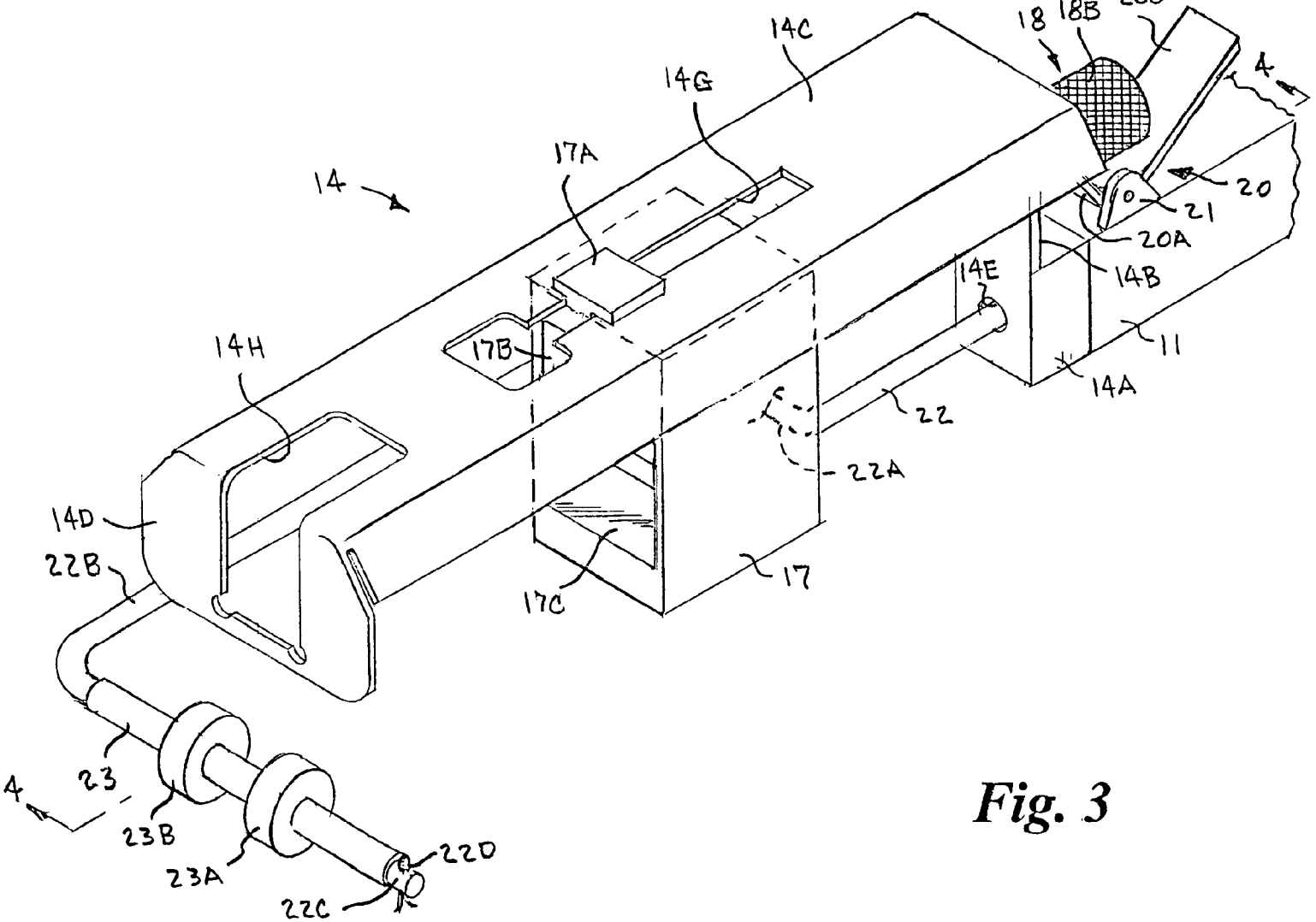
FIG. 3 is an isometric view of a preferred embodiment of the mounting receptacle of the extension arm device.
Figure 4:
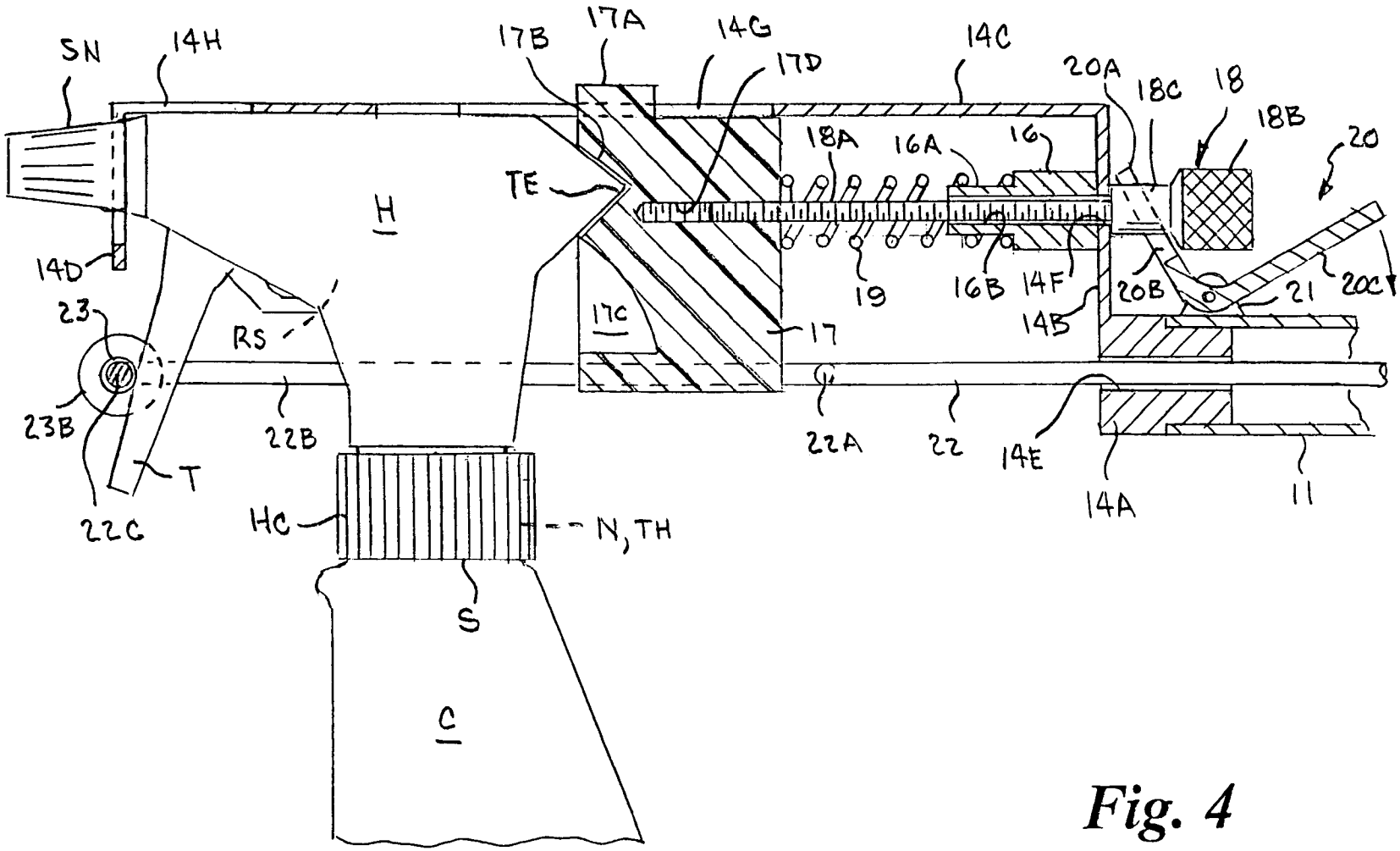
FIG. 4 is a longitudinal cross section of the mounting receptacle taken along line 4—4 of FIG. 3, showing a conventional trigger pump head removably secured thereto.

As best seen in FIGS. 3 and 4, the mounting receptacle 14 has an end plug or cap portion 14A that is fixed to the distal end of the extension arm 11 by a press fit, screws, epoxy, or other conventional means well known in the art, and therefore not shown in detail, a first vertical leg 14B that extends upwardly from the end plug or cap portion, and adjoins a longer horizontal leg 14C which extends forwardly therefrom and terminates in a short vertical downturned front end 14D. A lower hole 14E is formed through the end plug or cap portion 14A of the mounting receptacle 14, and an upper hole 14F is formed through the first vertical leg 14B that extends upwardly from the end plug or cap portion. A collar member 16 is secured to the forward facing surface of the first vertical leg 14B and has a reduced diameter front portion 16A and central bore 16B that extends therethrough in axial alignment with the upper hole 14F in the first vertical leg 14B of the mounting receptacle 14.

The mid portion of the horizontal leg 14C has a generally T-shaped longitudinal slot 14G formed therein and an second slot or aperture 14H at its forward end which extends a short distance along the horizontal leg 14C and the downturned front end 14D. The second slot or aperture 14H is configured to accommodate the forward end of the body of the conventional trigger pump spray head H, as explained in more detail hereinafter.

A generally rectangular clamping member 17 is slidably mounted on the horizontal leg 14C of the mounting receptacle 14. The clamping member has a T-shaped protrusion 17A at its top end, which is installed through the wider transverse portion of the T-shaped longitudinal slot 14G and slidably retained in the longitudinal portion of the slot. The front face of the clamping member 17 has one or more transverse recesses 17B, 17C sized and shaped to accommodate the rear end of the conventional trigger pump spray head H, as explained in more detail hereinafter. A threaded bore 17D extends inwardly from the back end of the clamping member 17 in axial alignment with the upper hole 14F in the first vertical leg 14B of the mounting receptacle 14 and the central bore 16B of the collar 16.

An adjustment screw 18 having an elongate threaded shank 18A at its forward end extends slidably through the upper hole 14F in the first vertical leg 14B of the mounting receptacle 14 and central bore 16B of the collar 16 and is threadedly engaged in the threaded bore 17D of the clamping member 17. The outer end of the adjustment screw 18 has a larger diameter knurled head 18B with a reduced diameter neck portion 18C disposed adjacent to the rear facing surface of the first vertical leg 14B of the mounting receptacle 14. A compression spring 19 surrounds the threaded shank 18A of the adjustment screw 18 and has one end engaged on the back end of the clamping member 17 and its opposed end engaged on the collar 16 to normally bias the clamping member 17 to a forward position. The user may manually adjust the distance of the front face of the clamping member 17 and its recesses 17B, 17C relative to the downturned front end 14D of the mounting receptacle 14 by rotating the head 18B of the adjustment screw 18.

A generally L-shaped bell crank lever 20 may be pivotally mounted between a pair of ears 21 on the top of the tubular arm 11 rearwardly of the first vertical leg 14B of the mounting receptacle 14. The bell crank lever 20 has a first leg 20A provided with a slot 20B that straddles the reduced neck portion 18C of the adjustment screw 18 and engages the larger diameter knurled head 18B of the adjustment screw. The second leg 20C of the bell crank lever 20 extends angularly upward and rearward from the pivotal connection and is sized to receive the thumb of the user. When the leg 20C of the bell crank lever 20 is depressed, the other leg 20A will engage the adjustment screw head 18B and pull adjustment screw 18 rearward to retract the clamping member 17 a distance rearward from its normally biased forward position and, when released, the compression spring 19 returns the clamping member 17 to its normally biased forward position.

It should be understood that the present device may also be provided without the bell crank lever 20, in which case the used may manually retract the gripping member 17 by gripping the head 1B of the adjustment screw 18 and pulling it rearward, and then releasing it to allow the compression spring 19 to return the clamping member 17 to its normally biased forward position.

An elongate actuator rod 22 passes slidably through the hole 14D in the end plug or cap portion 14A of the mounting receptacle 14, extends through the interior of the extension arm 11 and is connected to the trigger 13 at the proximal end, as described hereinafter. The outer end of the actuator rod 22 is disposed a short beneath the downturned end 14D of the mounting receptacle 14. The outer end of the actuator rod 22 adjacent to the distal end of the extension arm 11 is bent to form a contiguous lateral portion 22A, that extends a distance outwardly to one side, a straight side portion 22B extending forwardly therefrom, and an inwardly bent finger portion 22C that is perpendicular to the longitudinal axis of the actuator rod 22. The bent outer portion of the actuator rod 22 is sized and shaped so as accommodate, and not obstruct, the gripping member 17 and the manual pump spray head H when the container is installed in the mounting receptacle 14, as described hereinafter.

A tubular trigger-engaging sleeve 23 formed of low friction material having a pair of laterally spaced apart larger diameter guide members 23A, 23B may be rotatably mounted on the inwardly bent finger portion 22C to accommodate and properly align the existing trigger T of the conventional pump spray head H and prevent lateral slippage when engaged therewith. The outer end of the finger portion 22C may be flattened, or provided with a pin 22D, or other conventional retaining means well known in the art, to retain the sleeve 23 on the finger portion. The guide members 32A, 23B straddle the existing manual trigger T of the pump spray head H, and maintain the trigger T and the pump head H in a proper operating position and prevent it from swiveling to either side.

As shown in FIGS. 1 and 4, the conventional manual pump spray container C has a neck portion N surrounding the container opening with external threads TH at its upper end, and a larger shoulder portion S at the base of the neck portion. The conventional trigger pump spray head H has a spray nozzle SN at its forward end, a manual trigger T, an internally threaded cap HC at its bottom end for threadedly engaging it onto the threaded neck of the container C, and a liquid conducting dip tube that extends into the container and carries liquid from the container to the interior pump mechanism of the spray head (conventional and therefore not shown). The conventional trigger pump spray head H typically includes a return spring RS that returns the trigger T to its extended position after it has been pulled (conventional and therefore not shown in detail).

Some trigger pump spray heads may have an elongated grip portion above the cap for grasping by a user, and some conventional containers may have a handgrip portion beneath the threaded neck. Thus, conventional trigger pump spray heads may vary in vertical length, and the containers may also be of various shapes and sizes, however, the dimensions and thread sizes of the of the threaded neck portion N of the container C and the threaded cap HC of the pump head H are of industry standard sizes.

Conventional trigger pump spray heads also have a protruding or extended back end and vary slightly in horizontal length from the spray nozzle SN to the back end. However, the extended back end of conventional commercially available trigger pump spray heads fall into just several different profiles or styles, depending upon the manufacturer. The extended back end of the body of most all of the conventional commercially available trigger pump heads converge in a transverse tip end TE.

As shown in FIG. 4, the transverse recesses 17B, 17C in the front face of the clamping member 17 are sized and shaped to receive the transverse tip end TE of the back end of the conventional trigger pump spray head H.

In this embodiment, the conventional manual pump spray container C having the trigger pump spray head H mounted thereon is installed on the mounting receptacle 14 by depressing the leg 20C of the bell crank lever 20 or pulling the adjustment screw 18 rearwardly to retract the clamping member 17, as described above, placing the spray head into the mounting receptacle 14 such that the top end of the head is disposed closely adjacent to the underside of the horizontal leg 14C of the mounting receptacle and the spray head nozzle SN is protruding outwardly through the slot or aperture 14H in the downturned front end 14D, and then releasing the bell crank lever or adjustment screw such that the compression spring 19 returns the clamping member 17 to its normally biased forward position. When the clamping member 17 resumes its forward position, the corresponding transverse recess 17B of the clamping member engages the transverse tip end TE of the back end of the trigger pump spray head H, and the body of the spray head is firmly and securely clamped between the downturned front end 14D of the mounting receptacle 14 and the clamping member 17 by the spring force of the compression spring 19.

Thus, the mounting receptacle 14 receives and releasably grips the trigger pump spray head H and holds the pump spray container C generally perpendicular to the extension arm 11.

Because the mounting receptacle 14 is designed to accommodate most all of the conventional commercially available trigger pump spray heads, the present extension arm device 10 can be used with substantially any conventional trigger pump spray container and pump head that a user may desire to employ therewith.

Figure 5:
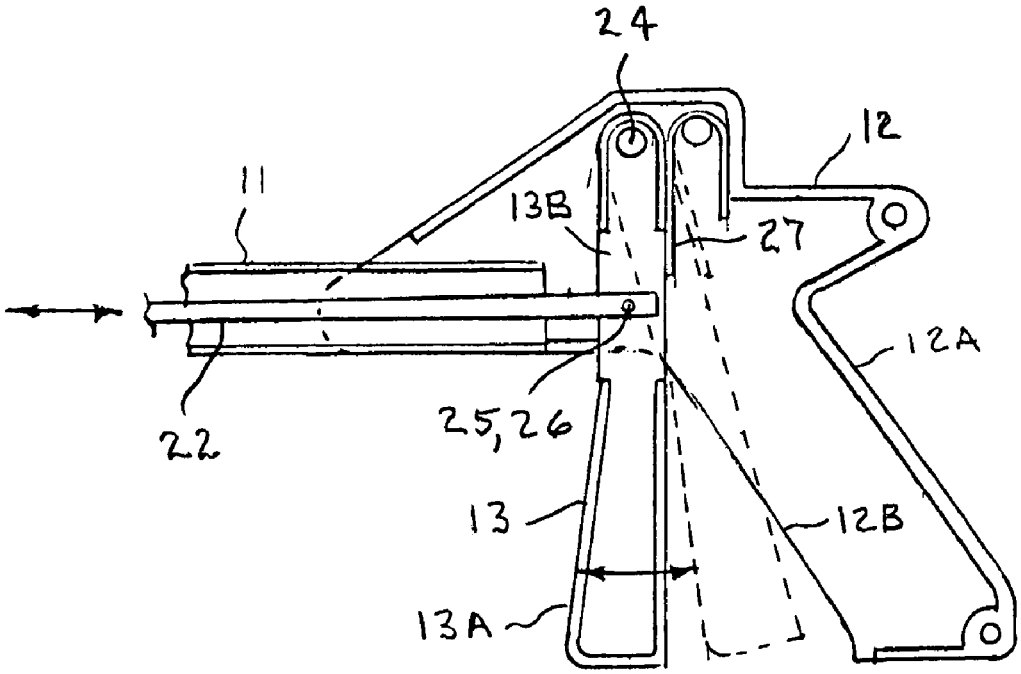
FIG. 5 is a cross sectional view of the pistol grip handle and trigger assembly at the proximal end of the extension arm, showing the connection of the actuator rod to the trigger.

FIG. 5 illustrates the construction of the pistol grip handle 12 and trigger 13 assembly at the proximal end of the extension arm 11 and the connection of the actuator rod 22 to the trigger. The handle 12 and trigger 13 are each preferably made of two piece or two sided injection molded plastic parts, as is conventional in the art, having side walls defining a hollow interior. The handle sides 12A (one side shown) are secured together and fixed to the proximal end of the extension arm 11 by screws, or other conventional means well known in the art, and therefore not shown in detail. The trigger sides 13A (one side shown) are also secured together by conventional means and have an opening 13B formed in the upper portion of the trigger side walls to receive the inner facing end of the actuator rod 22. The upper end of the trigger 13 extends through an opening 12B defined between the handle sides and is pivotally mounted therein by a pivot pin 24 extending through the handle sides.

The inner facing end of the actuator rod 22 passes through the openings 13B formed in the upper portion of the trigger side walls and has a transverse hole 25 extending therethrough which receives a pivot pin 26 passed through the trigger sides to pivotally mount the rod to the trigger 13 at a location spaced below the upper pivot pin 19.

Optionally, a supplemental trigger return spring 27, such as a U-shaped leaf spring may be installed in the handle and trigger assembly with its free ends engaged between the trigger 13 and the handle 12 so as to provide a supplemental biasing force to return the trigger to its extended position after it has been pulled. Alternatively, the optional trigger return spring may be a torsion spring installed in the handle and trigger assembly around the pivot connection, or other type of conventional spring engaged between the trigger and the handle to provide a supplemental biasing force.

Figure 6:
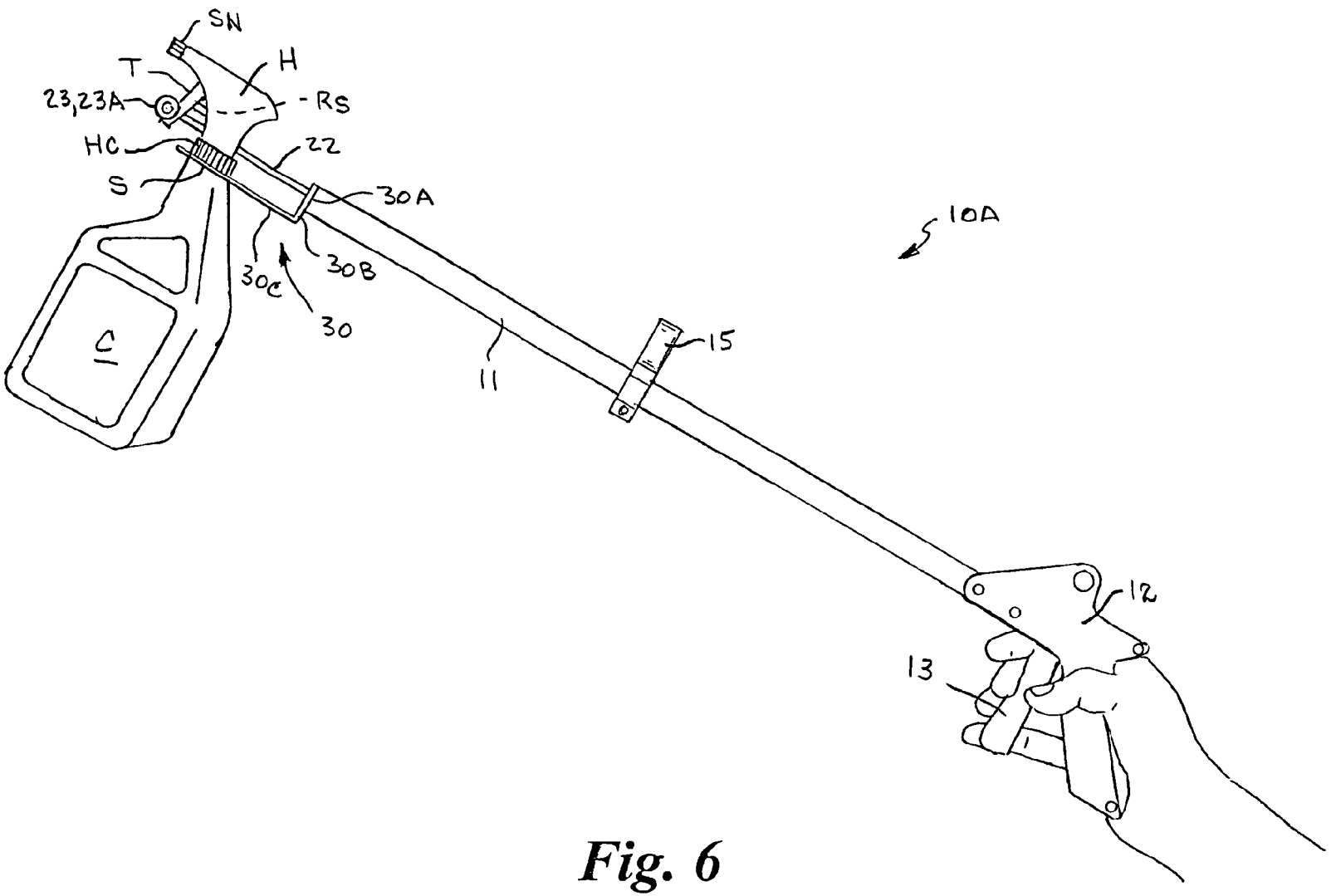
FIG. 6 is a perspective view of a second embodiment of the extension arm device in accordance with the present invention, having a conventional manual trigger pump spray container mounted at one end thereof.

Referring now to FIG. 6, there is shown a second embodiment of the extension arm device 10A having a different type of mounting receptacle 30 at one end thereof for releasably mounting a conventional manual trigger pump spray container C equipped with a manual trigger pump spray head H.

The embodiment of FIG. 6 has the same elongate tubular arm member 11 and pistol grip 12 and trigger 13 assembly secured at its proximal end as described previously. The components that are the same as shown and described in the previous embodiment are assigned the same numerals of reference, but will not be described again in detail to avoid repetition.

In this embodiment, the mounting receptacle 30 at the distal end of the arm 11 has and end plug or cap portion 30A that is fixed to the distal end of the extension arm 11 by a press fit, screws, epoxy, or other conventional means well known in the art, and therefore not shown in detail, and a generally L-shaped portion formed of flat plate material having a short vertical leg 30B that extends downwardly from the end plug or cap portion and adjoins a longer forwardly extending horizontal leg 30C. A central hole 30D is formed through the end plug or cap portion 30A of the mounting receptacle.

Figure 7:
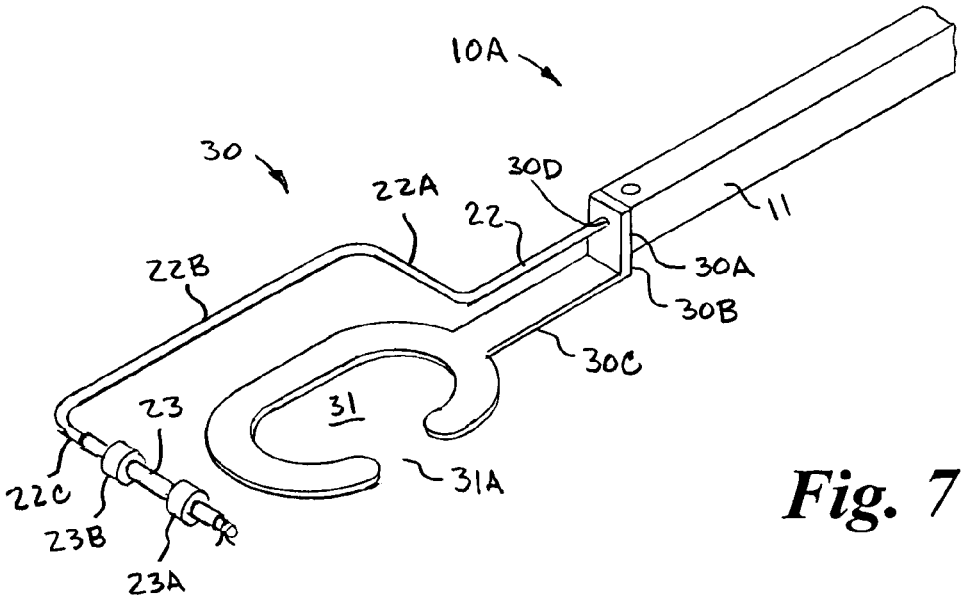
FIG. 7 is an isometric view of a first embodiment of the mounting receptacle of the extension arm device of FIG. 6.
Figure 7A:
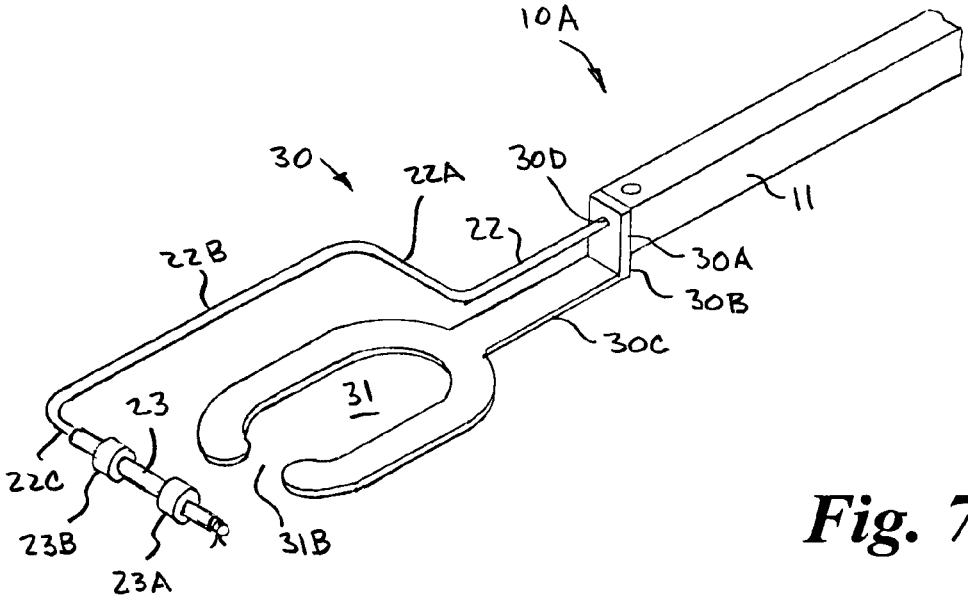
FIG. 7A is an isometric view of an alternate embodiment of the mounting receptacle.

As best seen in FIG. 7, the forwardly extending horizontal leg 30C has a central elongate longitudinal slot 31 formed therein with a lateral opening 31A extending from one side of the slot to the exterior of the horizontal leg. Alternatively, as shown in FIG. 7A, the horizontal leg 30C may have a central elongate longitudinal slot 31 formed therein with an opening 31B extending from the forward end of the slot to the exterior of the horizontal leg.

As with the previous embodiment, the elongate actuator rod 22 passes slidably through the hole 30D in the end plug or cap portion 30A of the mounting receptacle 30, extends through the interior of the extension arm 11 and is connected to the trigger 13 assembly at the proximal end, as described previously. The outer end of the actuator rod 22 is disposed a short distance above the horizontal leg 30C of the mounting receptacle 30. The outer end of the actuator rod 22 adjacent to the distal end of the extension arm 11 is bent to form a contiguous lateral portion 22A, that extends outwardly a direction toward one side or the side opposite the lateral opening 31A in the leg 30C of the mounting receptacle 30, a straight side portion 22B extending forwardly therefrom, and an inwardly bent finger portion 22C that is perpendicular to the longitudinal axis of the actuator rod 22. The inwardly bent finger portion 22C is also preferably provided with the trigger-engaging sleeve 23 and larger diameter guide members 23A and 23B. In this embodiment, the bent outer portion of the actuator rod 22 is sized and shaped so as accommodate, and not obstruct, the manual pump spray head H when the container is installed in the mounting receptacle 14, as described hereinafter.

Figure 8:
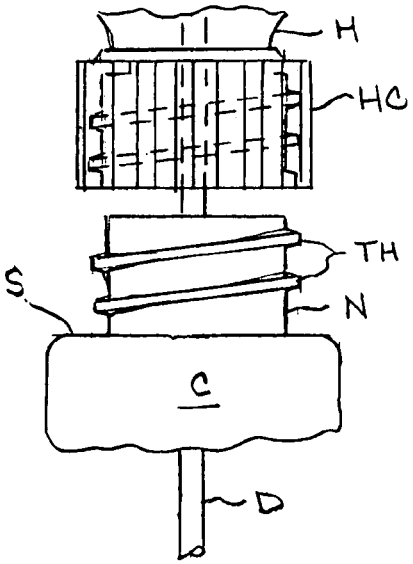
FIG. 8 is a side elevation view of the threaded neck portion of a conventional spray container and the cap and lower portion of a conventional trigger pump head.
Figure 9:
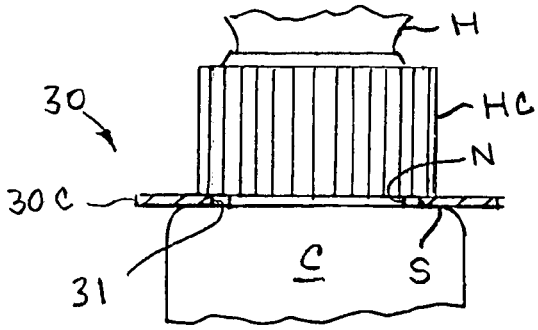
FIG. 9 is a side elevation view of the mounting receptacle of FIG. 7 captured between the shoulder portion of the conventional spray container and the cap of the conventional trigger pump head.

As shown in FIGS. 6, 8 and 9, as described above, the conventional manual pump spray container C has a neck portion N surrounding the container opening with external threads TH at its upper end, and a larger shoulder portion S at the base of the neck portion. The conventional trigger pump spray head H contains a spray nozzle SN and a trigger T, an internally threaded cap HC at its bottom end for threadedly engaging it on the threaded neck of the container C, a liquid conducting dip tube D that extends into the container and carries liquid from the container to the pump head, and typically includes a return spring RS that returns the trigger T to its extended position after it has been pulled (conventional and therefore not shown). As discussed above, the dimensions of the threaded neck portion N of the container C and the threaded cap HC of the pump head H are of industry standard sizes.

Figure 10:
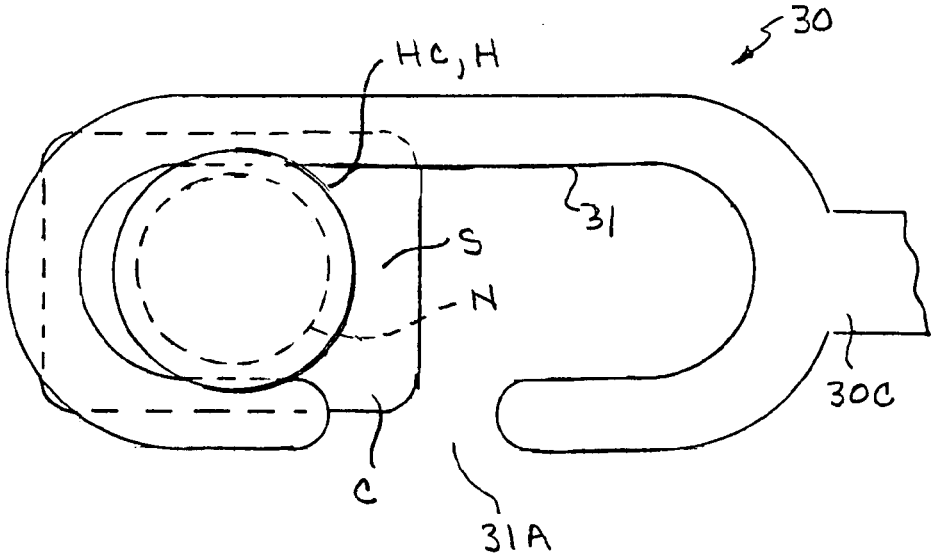
FIG. 10 is a top plan view, showing somewhat schematically, the mounting receptacle of FIG. 7 captured between the shoulder portion of the conventional spray container and the cap of the conventional trigger pump head.

As shown somewhat schematically in FIGS. 8 through 10, the slot 31 and the opening 31A of the mounting receptacle 30 are of sufficient width to slidably receive the reduced diameter neck portion N beneath the threads TH of the conventional manual pump spray container, and narrower than the larger shoulder portion S of the container and the outer periphery of the threaded cap HC of the trigger pump spray head H. The reduced diameter neck portion N of the container is slidably received in the lateral opening 31A of the mounting receptacle 30 and positioned in the slot 31.

In this embodiment, the trigger pump spray head H is installed by screwing the cap HC onto the container neck N such that the cap is held loosely thereon. The container C with the trigger pump spray head H loosely attached thereto is adjustably positioned in the slot 31 such that the spray head trigger T in its extended position is engaged on the sleeve 23 of the inwardly bent finger portion 22C of the actuator rod 22. The cap HC of the spray head H is then tightened to engage and firmly sandwich or clamp the horizontal leg 30C of the mounting receptacle 30 between the shoulder portion S of the container C and the bottom of the cap HC of the trigger spray head. Thus, the mounting receptacle 30 receives and releasably holds the pump spray container C generally perpendicular to the extension arm 11.

Because the mounting receptacle 30 is designed to accommodate the threaded neck portion N of the container C and the mating cap HC of the pump head, which are industry standard sizes, the extension arm device 10A can be used with substantially any conventional trigger pump spray container and pump head that a user may desire to employ therewith.

OPERATION

Referring now to FIGS. 1, 5 and 6, when the trigger 13 at the proximal end of the extension arm 11 is squeezed, the actuator rod 22 is retracted against the spring force of the existing return spring RS in the trigger pump spray head H, and the optional supplemental trigger return spring 27, if installed in the handle and trigger assembly, and the trigger T of the pump head H is retracted by the finger portion 22C of the actuator rod 22. When the squeezing pressure is removed from the trigger 13 at the proximal end of the extension arm, the actuator rod 22, and the trigger T of the pump head H are returned to their extended position by the spring force of the existing return spring RS in the trigger pump spray head, and the supplemental trigger return spring 27, if installed in the handle and trigger assembly. Thus, when a user squeezes the trigger 13, the liquid in the pump spray head H is forced by the trigger T of the pump spray head H to spray from the nozzle SN and additional liquid is drawn upwardly through conducting dip tube D to the pump head.

While this invention has been described fully and completely with special emphasis upon preferred embodiments, it should be understood that within the scope of the appended claims the invention may be practiced otherwise than as specifically described herein.

The invention claimed is:

1. An extension arm for holding, manipulating, and remote operation of a conventional trigger pump spray container of the type having a manual trigger pump spray head containing a pumping mechanism, a spray nozzle at a front end, a trigger connected with the pumping mechanism, a trigger return spring for returning the trigger to an extended position after it has been squeezed, and a liquid conducting dip tube that extends into the container, the extension arm comprising:

an elongate arm having a hand grip and trigger assembly at a proximal end, and a mounting receptacle at a distal end for releasably receiving and securing the trigger pump spray container and pump spray head thereto in a vertical position generally perpendicular to said elongate arm; and actuating means having a proximal end connected with said trigger assembly, and having a trigger engaging portion at a distal end for engaging and operating the trigger of the pump spray head received in said mounting receptacle; wherein manual reciprocation of said trigger assembly at the proximal end of said elongate arm is transmitted by said actuating means trigger engaging portion to the pump spray head trigger and pumping mechanism to pump liquid from the container through the dip tube and discharge it through the spray nozzle.

2. The extension arm according to claim 1 wherein said mounting receptacle is configured to receive and secure conventional trigger pump spray containers and pump spray heads of different sizes and shapes.

3. The extension arm according to claim 1 wherein said elongate arm is a tubular arm; and said actuating means extends through the interior of said tubular arm and its said trigger engaging portion extends outwardly from the distal end of said arm.

4. The extension arm according to claim 3, wherein said actuating means comprises an elongate rod extending axially through said tubular arm connected at a proximal end with said trigger assembly, and its said outwardly extending end is bent to form said trigger engaging portion.

5. The extension arm according to claim 1, wherein said hand grip and trigger assembly comprises a pistol grip and trigger member pivotally connected at an upper end thereto.

6. The extension arm according to claim 1, further comprising:

a second hand grip member on said elongate arm disposed between said hand grip and trigger assembly and said mounting receptacle.

7. The extension arm according to claim 1, further comprising:

clamping means on said mounting receptacle configured to receive and releasably grip the pump spray head of the conventional trigger pump spray container.

8. The extension arm according to claim 7, wherein the manual trigger pump spray head of the conventional trigger pump spray container has a back end; and said clamping means comprises a retractable clamping member configured to receive and releasably engage the back end of the pump spray head.

9. The extension arm according to claim 8, wherein said mounting receptacle has a front end configured to receive the spray nozzle at the front end of the manual trigger pump spray head.

10. The extension arm according to claim 9, further comprising:

adjustment means on said mounting receptacle engaged with said retractable clamping member for adjusting the distance between said mounting receptacle front end and said clamping member to accommodate pump spray heads of different sizes.

11. The extension arm according to claim 9, further comprising:

resilient biasing means on said mounting receptacle engaged with said retractable clamping member to normally bias said clamping member to a forward extended position and releasably clamp the pump spray head of the conventional trigger pump spray container between said clamping member and said mounting receptacle front end.

12. The extension arm according to claim 9, further comprising:

retracting means engaged with said retractable clamping member for retracting said clamping member to a rearward retracted position to allow installation and removal of the pump spray head between said mounting receptacle front end and said clamping member.

13. The extension arm according to claim 1, wherein the conventional trigger pump spray container has an externally threaded neck portion and the manual trigger pump spray head has an internally threaded cap at its bottom end threadedly engageable with the threaded neck portion;

said mounting receptacle has a flat planar portion with an aperture for receiving the threaded neck portion of the container, a bottom surface engageable with the container beneath its threaded neck portion, and a top surface for engaging a bottom surface of the threaded cap; and said flat planar portion is clamped between the bottom surface of the threaded cap when the threaded cap is threadedly engaged with the threaded neck portion of the container and tightened thereon.

14. The extension arm according to claim 13, wherein said mounting receptacle aperture comprises a central longitudinal slot having all opening extending therefrom to the outer periphery of said flat planar portion;

said longitudinal slot and said opening having a width of sufficient size to slidably receive the neck portion of the container beneath its threaded portion to allow installation and removal of the pump spray head.

15. The extension arm according to claim 1, further comprising:

resilient means in said hand grip and trigger assembly connected with the trigger member of said trigger assembly to urge said actuating means trigger engaging portion to a forward extended position after squeezing pressure is relaxed during manual reciprocation of said trigger assembly.

* * * * *